US005362041A

United States Patent [19]

Ryuzaki et al.

[11] Patent Number: 5,362,041

[45] Date of Patent: Nov. 8, 1994

[54] SHEET REGISTERING UNIT FOR AN IMAGE FORMING APPARATUS

[75] Inventors: Takahiko Ryuzaki; Yoshio Kogure; Hideo Ichikawa; Yasuo Nakamura; Takuji Miyazawa, all of Kanagawa, Japan

[73] Assignee: Fuji Xerox Co., Ltd., Tokyo, Japan

[21] Appl. No.: 45,428

[22] Filed: Apr. 13, 1993

[30] Foreign Application Priority Data

Apr. 16, 1992 [JP] Japan ..... 4-122625
Sep. 17, 1992 [JP] Japan ..... 4-273626

[51] Int. Cl.[5] ..... B65H 7/00

[52] U.S. Cl. ..... 271/236; 271/242; 271/250; 226/19

[58] Field of Search ..... 271/242, 250, 251, 227, 271/228, 236, 238; 226/19, 20

[56] References Cited

U.S. PATENT DOCUMENTS

| | | | |
|---|---|---|---|
| 3,637,122 | 1/1972 | Tokunaga | 226/19 X |
| 3,784,076 | 1/1974 | Avery | 226/19 X |
| 4,426,073 | 1/1984 | Mizuma | 271/251 |
| 4,685,664 | 8/1987 | Petersdorf | 271/250 X |
| 4,785,514 | 11/1988 | Kannwischer | 226/19 X |
| 4,799,084 | 1/1989 | Koike | 271/250 X |
| 4,805,892 | 2/1989 | Calhoun | 271/250 X |
| 5,215,300 | 6/1993 | Hiroi | 271/250 X |

FOREIGN PATENT DOCUMENTS

| | | | |
|---|---|---|---|
| 61-249063 | 11/1986 | Japan . | |
| 69439 | 3/1989 | Japan | 271/250 |
| 3-94275 | 4/1991 | Japan . | |

*Primary Examiner*—Richard A. Schacher
*Attorney, Agent, or Firm*—Finnegan, Henderson, Farabow, Garrett & Dunner

[57] ABSTRACT

A sheet registering unit for an image forming apparatus in which in the location upstream of the transfer stage, a preregistering roller device and a registering roller device are disposed while being separated with a predetermined distance from each other, and the leading edge of a sheet of paper is positioned with the aid of a loop of the sheet formed in a manner that the leading edge is thrust against the nip of the paired rollers of the registering roller device, and in this state the sheet is additionally pushed by the preregistering roller pair. In the sheet registering unit, the shafts supporting the roller members of the registering roller device or the roller members are supported by the combination of linear bearing members and springs, and by a pressure in the oblique direction caused in the sheet nipped by the registering roller device, the roller members of the registering roller device are shifted in the axial direction.

20 Claims, 14 Drawing Sheets

SHEET REGISTERING UNIT FOR AN IMAGE FORMING APPARATUS

BACKGROUND OF THE INVENTION

1. Field of the Invention

The present invention relates to the construction of a sheet registering unit disposed upstream of an image transfer stage in an image forming apparatus, e.g., a xerographic machine.

2. Discussion of the Related Art

In image forming apparatuses, such as electronic copying machines and laser based printing machines, a toner image is zerographically formed on an image bearing member, such as a photoreceptor drum. The toner image is transferred to and fixed on a sheet of paper, and output in the form of a copy or print. A sheet registering stage is located upstream of the image transfer stage. The leading edge of the sheet is positioned in a manner that the leading edge is pushed against a gate means in the sheet registering stage. Thereafter, the sheet is fed in synchronism with the toner image on the photoreceptor, so that the toner image is transferred onto the sheet. An example of the sheet registering unit is disclosed in Japanese Patent Unexamined Publication No. Hei. 3-94275. In the disclosed registering unit, registering roller means and gate means are located upstream of the photoreceptor. Preregistering roller means is disposed upstream of the registering roller means, both registering means being separated with a predetermined distance.

The registering unit operates such that the gate means temporarily holds the leading edge of the sheet, and the preregistering roller means additionally feeds the sheet, thereby forming a loop of the sheet. By the force generated in the looped sheet, the sheet leading edge is uniformly pushed against the gate means. Accordingly, when the advancing sheet is obliquely oriented with respect to the advancing direction, the oblique state of the sheet can be removed. In other words, the sheet leading edge is oriented at right angle to the advancing direction in a state that it is nipped by the registering roller means.

The conventional image forming apparatus includes a mechanism functioning such that when a line along which the sheet stops is deviated from the reference line, the registering roller means is laterally moved in accordance with a quantity of the deviation. More specifically, the apparatus laterally moves the registering roller means to make the side of the sheet coincident with the reference line of the sheet advancing path, and drives the registering roller means in synchronism with the toner image on the rotating photoreceptor drum, to move the sheet toward the image transfer stage. As in the conventional image forming apparatus, the image forming apparatus using the linearly-arranged registering unit can form a loop of the sheet by the registering unit and move the registering roller means laterally with respect to the sheet advancing direction by the related mechanism. Accordingly, the apparatus can transport the sheet in a state that the sheet position is corrected with respect to the photoreceptor. The image forming apparatus is free from the problem of the out-of-register of the toner image that is to be transferred onto the sheet.

In some type image forming apparatuses, the registering unit including the sheet transport path cannot be arranged linearly. Accordingly, it must be nonlinearly arranged frequently. The nonlinearly arranged registering unit including the sheet transport path will be described with reference to FIGS. 32 to 40.

In a color copying machine like an image forming apparatus 1 shown in FIG. 32, a sheet of paper is fed out of one of sheet supply trays 10, which are arrayed in a multi-stage fashion, and transported for its register to a sheet registering unit 20, along a sheet transport path 13. A toner image formed on a photoreceptor 3, which takes the form of a drum, is transferred to the supplied sheet in a state that the sheet is held around the photoreceptor 3 located downstream of the registering unit 20.

In the image forming apparatus 1 as the color copying machine, sheet feed means for feeding sheets from the sheet supply tray 10 include a sheet pick-up roller 11 and a sheet feed roller pair 12. A transport roller pair 14 is disposed in the sheet transport path 13. Thus, sheets supplied from the sheet supply tray 10 are transported sheet by sheet toward the registering unit 20. Another sheet feed mechanism including a pick-up roller 16 is provided for feeding sheets supplied from a manual inserter tray 15 into the registering unit. The sheet fed by any of those sheet feed mechanisms is temporarily stopped and then fed toward the transfer drum.

In the registering unit 20, a preregistering roller device 30 is disposed upstream of a curved path 21, and a registering roller device 31 is disposed downstream of the curved path. In operation, to loop the sheet, the preregistering roller device 30 additionally feeds the sheet in a state that the leading edge of the sheet is nipped by the registering roller device 31. The pressure of the looped sheet functions to remove the oblique state of the sheet. A pressure roller 5 presses the sheet emanating from the registering roller device 31 against the surface of the transfer drum 2, and in this state the sheet is electrostatically attracted to the surface of the transfer drum 2. Every time a color toner image is formed on the surface of the transfer drum 2, the color toner image is transferred onto the sheet. The sheet holding member of the transfer drum 2 is made of a plastic film. The transfer drum 2 is further provided with a means for causing the plastic film to electrostatically hold the sheet.

The image forming apparatus shown in FIG. 32, the registering roller device 31 is the combination of a drive roller 32 and a pinch roller 42, as shown in FIG. 33. The registering roller device 31 moves forward the sheet in a state that it nips the sheet. As shown, the drive roller 32 is fastened to a predetermined location of a drive shaft 34. The pinch roller 42 is mounted around a shaft 44.

In the sheet transporting system shown in FIG. 32, various types of roller means are disposed along the sheet transport path 13. The sheet is transported through the pick-up roller 11, the transport roller pair 14, the preregistering roller device 30, and the registering roller device 31, and finally is pressed against the transfer drum 2 by means of the pressure roller 5.

In the sheet transport path (FIG. 34), a loop of the sheet is formed between both the roller devices 30 and 31 in the registering unit 20, as shown in FIG. 35. A film 24 is disposed at the corner of the inner side of the curved path 21. The film 24 pushes back the loop of the sheet, so that the leading edge of the sheet is pushed against the registering roller device 31. Thus, the film 24 functions to assist the loop of the sheet in regulating the orientation of the leading edge of the sheet.

Through the regulation of the leading edge orientation, as shown in FIG. 32, the sheet fed out of the registering unit 20 is pressed against the transfer drum 2 and is held by the drum, and the sheet is set on the surface of the transfer drum 2 in good conditions. To be more specific, when a sheet of paper P obliquely enters the registering unit 20 as shown in FIG. 36, the sheet advances between the roller devices 30 and 31 in the oblique state. The sheet further advances and its leading edge reaches the preregistering roller device 30. At this time, the sheet is temporarily stopped there while the sheet is additionally fed by the preregistering roller device 30. As the result of the additional feeding operation, the sheet is looped. A reaction force of the looped sheet forcibly aligns the leading edge of the sheet with the nip extension of the registering roller device 31, which is at a right angle to the leading edge of the sheet. In this way, even the obliquely advancing sheet can be normally set onto the drum surface.

When the sheet P, which is in a state as shown in FIG. 37, is moved toward the transfer drum 2, the sheet is pressed against the transfer drum 2 while undergoing a twisted force, and is electrostatically set on the drum surface. When the sheet is set on the drum surface, a reaction force in the twisting direction deforms the film member of the transfer drum 2 in its width direction, as shown in FIG. 39. The side P1 of the sheet supported by the drum is slightly displaced from the reference line a-1 along which the sheet should be held around the drum. As shown in FIG. 39, when the trailing edge of the sheet being held in the displaced state has passed the registering roller device 31, the reaction force of the twisting direction disappears. After the pressure of the sheet is removed, the reaction of the film causes the sheet to displace from the original position where the sheet has first been set, in the width direction. As a result, the sheet is returned to the position of the reference line a-1.

In the color copying machine as described above, when the leading edge of the sheet is held by the transfer drum 2 and the operation for setting the sheet on the drum continues, the transfer operation of a first color toner image is started. Before a second color toner image is transferred, the sheet is moved widewise by the film reaction force. As a result, the line Pa of the first color toner image is not aligned with the line Pb of the second color toner image with respect to the sheet advancing direction (see FIG. 40). In other words, a discrepancy in color is caused. A third color toner image to be transferred subsequent to the second color toner image, is also transferred along the same line as that of the second color toner image.

As described above, the sheet transporting system suffers from the discrepancy-in-color problem, or deterioration of the copy quality. The lateral displacement of the sheet during the transferring process of the first color toner image will possibly cause line displacement and image displacement in the first color toner image, and an improper transfer of the image.

One of the feasible ways to solve the above problem is to turn the transfer drum idle after the sheet is set on the drum, thereby removing the distortion of the film, and then to transfer the color toner image. The idle turning of the drum with the sheet held thereon leads to diminishing of the number of copies made per unit time.

SUMMARY OF THE INVENTION

The present invention has been made in view of the above circumstances and has an object to provide a sheet registering unit for an image forming apparatus which can exactly correct the orientation of the leading edge of a sheet of paper obliquely advancing, thereby eliminating problems involved in the toner image transfer process, such as the discrepancy-in-color, and the displacement of line and image.

To achieve the above object, the invention provides a sheet registering unit for an image forming apparatus in which in a location upstream of a transfer stage, a preregistering roller device and a registering roller device are disposed while being separated with a predetermined distance from each other, and a leading edge of a sheet of paper is positioned with the aid of a loop of the sheet formed in a manner that the leading edge is thrust against a nip of paired rollers of the registering roller device, and that the sheet is additionally pushed by the preregistering roller pair, wherein shafts supporting roller members of the registering roller device or the roller members are supported by a combination of linear bearing members and springs, and the registering roller device is provided slidably in an axial direction by a pressure in an oblique direction caused in the sheet nipped by the registering roller device.

Further, the invention provides a sheet transporting device for correcting a sheet transporting position, including first and second roller pairs including rotating shafts, the first roller pair being movable along the rotating shafts by a deflection force in an oblique direction that is generated in a sheet of paper in a state that the sheet is nipped by the second roller pair and in contact with the first roller pair.

Furthermore, the invention provides an image forming apparatus including a transfer drum having a flexible sheet holder member for electrostatically holding a sheet of paper on a surface of the transfer drum, and a sheet positioning device for supplying the sheet to the transfer drum, wherein the sheet positioning device includes first and second roller pairs including rotating shafts, the first roller pair being movable along the rotating shafts by a deflection force in an oblique direction that is generated in the sheet in a state that the sheet is nipped by the second roller pair and in contact with the first roller pair.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

A sheet registering unit for an image forming apparatus according to an embodiment of the present invention will be described.

Figure 1:
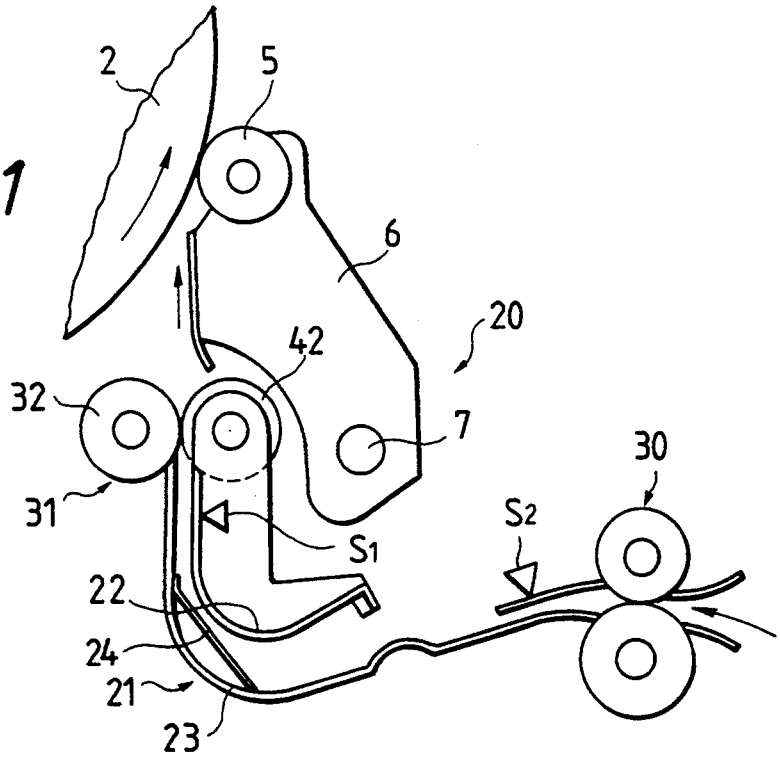
FIG. 1 is a sectional view showing a sheet registering unit according to the invention.
Figure 32:
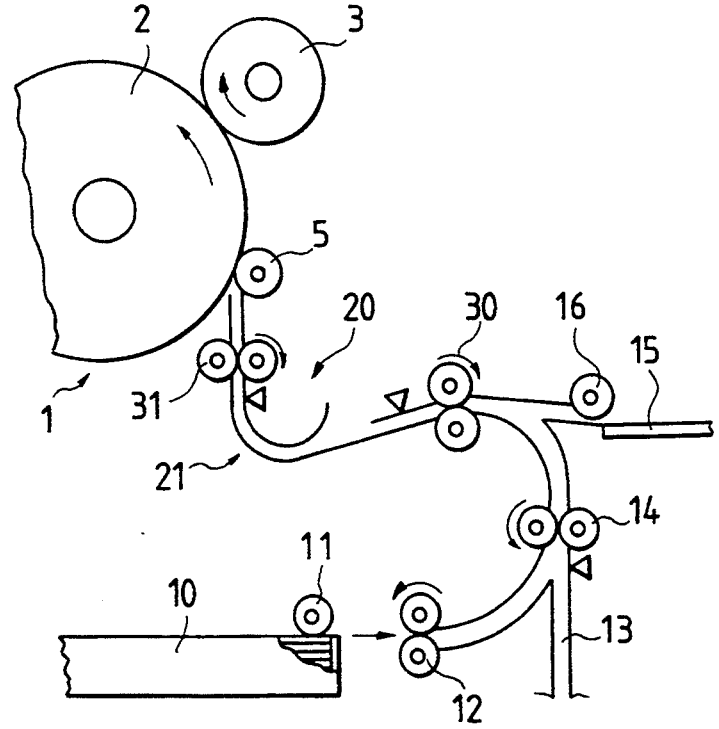
FIG. 32 PRIOR ART
FIG. 32 is a sectional view showing a conventional sheet transfer device for an image forming apparatus.
Figure 33:
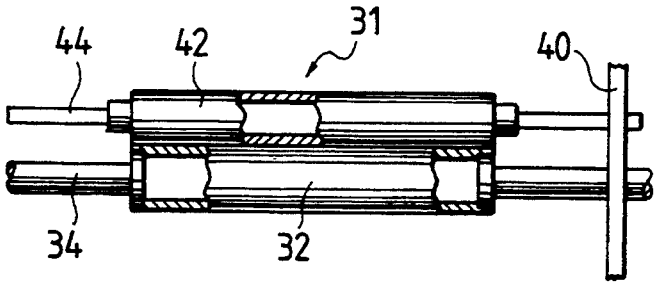
FIG. 33 PRIOR ART
FIG. 33 is a plan view, partly broken, showing a conventional registering roller device.
Figure 34:
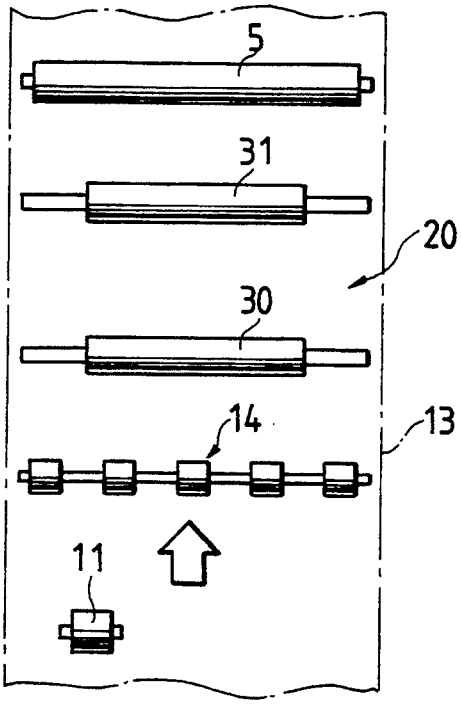
FIG. 34 PRIOR ART
FIG. 34 is a plan view showing the layouts of rollers in the sheet transporting device.
Figure 35:
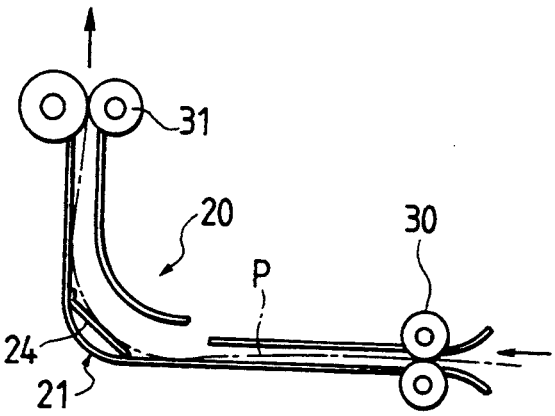
FIG. 35 PRIOR ART
FIG. 35 is a sectional view showing how the sheet is looped.
Figure 36:
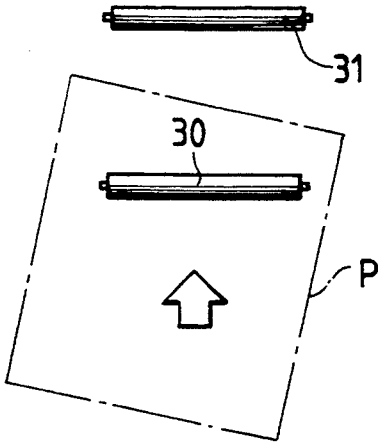
FIG. 36 PRIOR ART
FIG. 36 is a plan view showing how the sheet, obliquely oriented, enters the registering unit.
Figure 37:
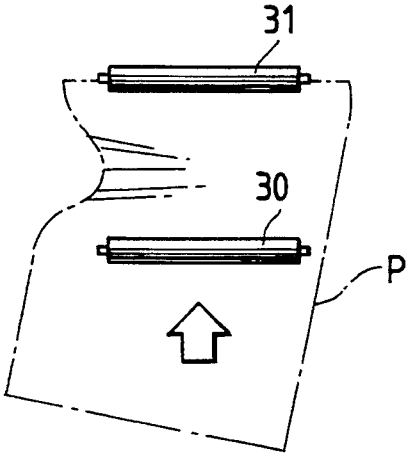
FIG. 37 PRIOR ART
FIG. 37 is a plan view showing a state of the sheet when it is looped.
Figure 38:
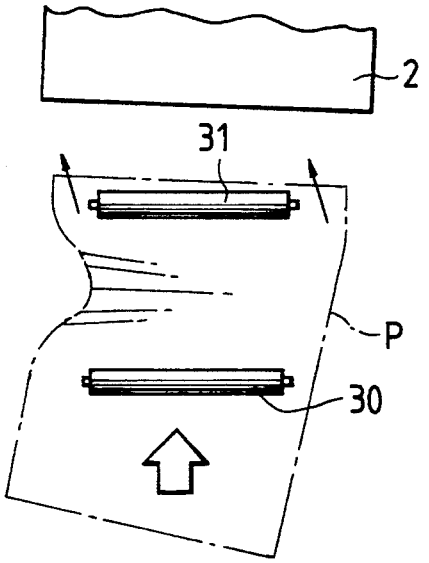
FIG. 38 PRIOR ART
FIG. 38 is a plan view showing how the looped sheet advances to the transfer drum.
Figure 39:
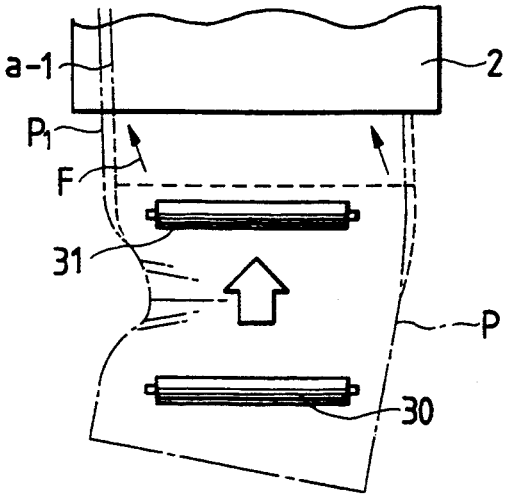
FIG. 39 PRIOR ART
FIG. 39 is a plan view showing a state that the sheet is set on the drum while being deviated from its original position.
Figure 40:
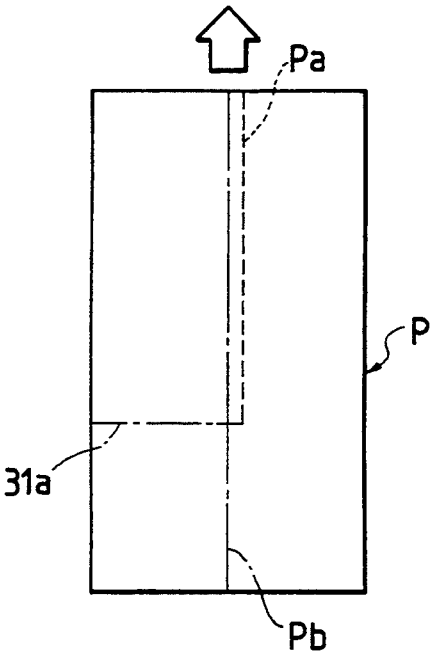
FIG. 40 PRIOR ART
FIG. 40 is an explanatory diagram showing how toner images are transferred onto the sheet incorrectly set on the drum surface.

Referring to FIG. 1, there is shown a sheet transporting system extending up to a transfer drum in an image forming apparatus, as illustrated in FIG. 32. In the sheet transporting system, a sheet registering unit 20 is disposed upstream of a transfer drum 2. In the registering unit 20, a preregistering roller device 30 is disposed upstream of a curved path 21, and a registering roller device 31, which includes a pair of rollers uniquely coupled as will be discussed in detail later, is disposed downstream of the same. The curved path 21 is defined by an inner guide plate 22 and an external guide plate 23. A film 24 is disposed at the corner within the curved path 21. The preregistering roller device 30 consists of a drive roller and a pinch roller, both being brought into contact with each other in the axial direction. The registering roller device 31 also consists of a drive roller 32 and a pinch roller 42 both being arranged in the same way. Both the rollers 32 and 42 are axially movable, as will be described with reference to FIG. 2 and subsequent figures.

The film 24 is preferably made of material, thin but good in elasticity, such as a PET film. The film 24 functions such that when the sheet is looped, it resists the force by a loop of the sheet, and when the force by the loop becomes weak, the film presses, with its resiliency, the looped sheet so as to remove or release the loop. Accordingly, when the sheet is moved forward by the registering roller device 31, the film 24 urges the loop of the sheet in the sheet forwarding direction. Disposed downstream of the registering device 20 are the transfer drum 2 for holding the sheet in the image transfer location and a pressure roller 5 for pressing the sheet against the transfer drum 2. The pressure roller 5 is supported by an arm 6, which may be turned about a shaft 7. A drive mechanism, not shown, drives the pressure roller 5 so as to press against the transfer drum 2 only when the sheet is set on the transfer drum 2.

Figure 2:
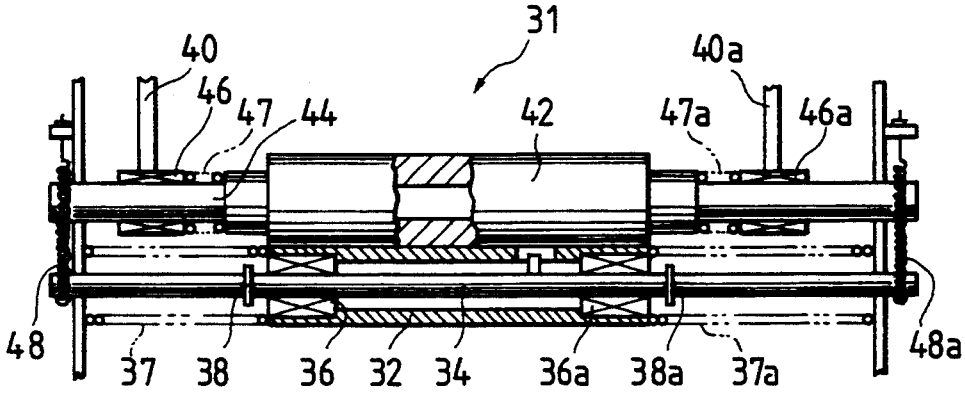
FIG. 2 is a sectional view showing the structure of a registering roller device in the registering unit.
Figure 3:
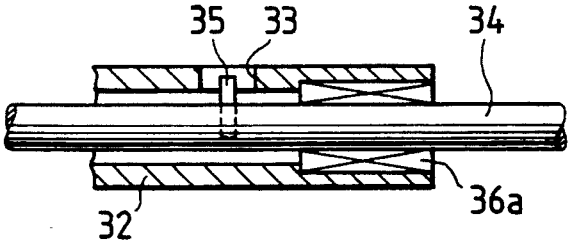
FIG. 3 is a sectional view showing how a drive roller and a drive shaft are coupled.
Figure 4:
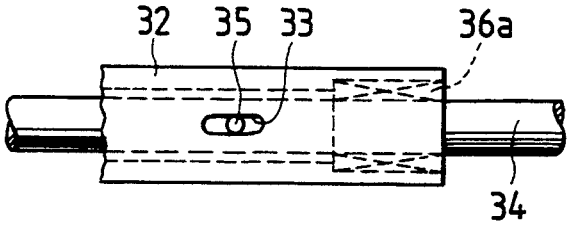
FIG. 4 is a plan view showing the structure of FIG. 3.

The registering roller device 31 of the registering unit shown in FIG. 1 may be constructed as shown in FIG. 2. In the registering roller device 31, a couple of linear bearing members 36 and 36*a* interpose between a drive shaft 34 and the drive roller 32 to be supported by the drive shaft 34 in a state that the linear bearing members allow the drive roller 32 to be axially shiftable in response to a weak force applied thereto. A pin 35 planted on the drive shaft 34 engages with an elongated hole 33 of the roller member of the drive roller 32. Through the pin-elongated hole coupling, a drive force is transferred from the drive shaft to the roller member (see FIGS. 3 and 4). Accordingly, if the roller is moved with respect to the drive shaft, a drive force of the drive shaft can be transmitted through the pin to the roller member. A spring 37 is disposed between one end of the roller member and the corresponding frame, and another spring 37*a* is disposed between the other end thereof and the corresponding frame. The structure allows a pressure force to be uniformly applied to the drive roller 32 from both the sides thereof. In order to set up a limited range within which the roller member is movable in the axial direction, stoppers 38 and 38*a*, such as E rings, are mounted to both ends of the drive shaft 34.

Figure 5:
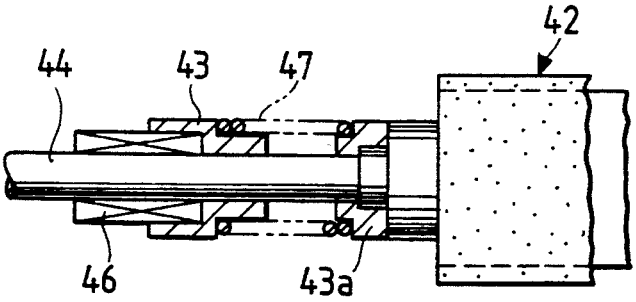
FIG. 5 is a sectional view showing how a pinch roller and its support shaft are coupled.

In the pinch roller 42, which is disposed in opposition to the drive roller 32, a rubber roller member is fastened to a support shaft 44. The support shaft 44 is supported, by means of linear bearing members 46 and 46*a*, on frames 40 and 40*a* in a manner that the pinch roller, together with the shaft, is axially movable. Springs 47 and 47*a* are provided on both sides of the pinch roller 42. To be more specific, as shown in FIG. 5, the spring 47 is disposed between a bracket 43 of the linear bearing member and another bracket 43*a* located closer to the pinch roller 42. Provision of the spring allows the pinch roller, together with the support shaft, to be slidable. Spring members 48 and 48*a* are provided for the two shafts, as shown in FIG. 2, in order to create a predetermined nip pressure between the two roller members. Supporting means, which allow the shaft supporting the pinch roller to be moved, are used for mounting the spring members 48 and 48*a*. Any suitable mechanism may be used for mounting the springs.

In the registering roller device 31, since the two roller members are axially movable, the sheet, if it is in a twisted state, can be fed out of the registering unit in a state that the reaction force of the sheet causes the roller members to move in its width direction. Accordingly, the registering unit of the invention is free from the following situation. The sheet fed out of the registering unit, while conserving the reaction force in the twisted direction, is set around the film member constituting the sheet support surface of the transfer drum 2. As a result, the film member is deformed, and the transfer drum is laterally moved.

Figure 6:
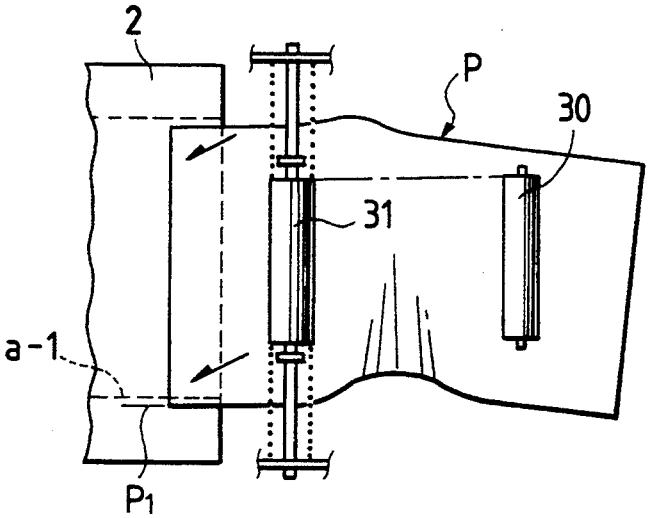
FIG. 6 is a plan view showing a state of sheet discharged from a conventional registering unit.

In the conventional registering unit of the type in which the registering roller device 31 is not provided with the mechanism, which allows the roller pair to move in the width direction, when the sheet is looped in a state that the sheet is temporarily stopped by the registering roller device 31, as shown in a plan view of FIG. 6, and thereafter, the registering roller device 31 is driven to feed the sheet, the side P1 of the sheet P is displaced from the sheet hold line a-1 of the transfer drum 2.

Figure 7:
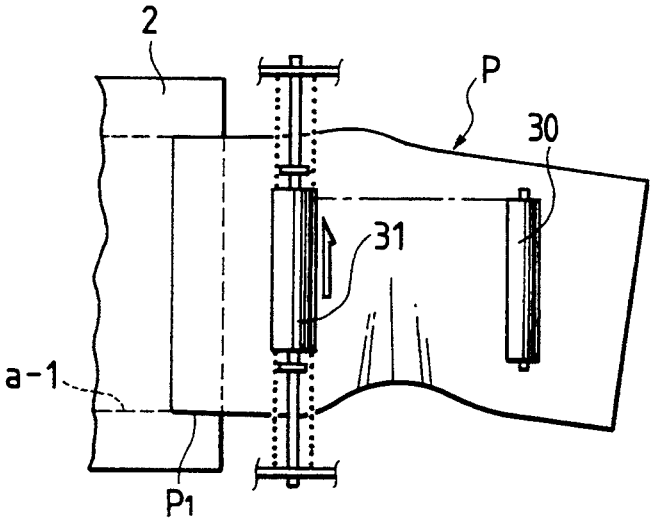
FIG. 7 is a plan view showing a state of sheet discharged from the registering unit of the invention.

On the other hand, in the registering roller unit of the invention, as shown in FIG. 7, when the sheet is looped between the preregistering roller device 30 and the registering roller device 31, the reaction force of the sheet in the twisting direction causes the registering roller device 31 to move in its width direction. When the sheet nipped by the registering roller device 31 contains a reaction force of the twisting direction, the reaction force of the sheet moves the roller members of the registering roller device 31 in its width direction, thereby relieving or removing the reaction force. As a result, the sheet set on the transfer drum 2 is supplied in a state that the side P1 of the sheet P is coincident with the normal sheet hold line a-1.

As already described, the sheet, which emanates from the registering unit and is attracted onto the transfer drum, does not apply any additional force to the film member constituting the sheet holder on the transfer drum. Accordingly, the sheet can be supplied while keeping the original position where the sheet has been first set. Therefore, the first color toner image and the subsequent ones to be transferred onto the sheet are in register. The resultant color image has good picture quality. In the case of the registering roller device 31, after the sheet has passed through the registering paired rollers, the reaction force of the sheet acting on the roller members is relieved or removed, so that the roller members can be smoothly returned to the original positions by the springs.

In the instant embodiment of the invention, the leading edge of the sheet is put into the nip between the paired rollers of the registering roller device, and in this state the sheet is looped. By the reaction force of the looped sheet, the roller members of the registering roller device are axially moved together, whereby the sheet is supplied without lateral deviation. The construction of the registering roller device 31 as mentioned above has the following problems. The pinch roller often fails to exactly follow the motion of the drive roller in the axial direction. After the sheet leaves the registering roller device 31 the pinch roller often stops during the course of its returning to the neutral positions. In this case, the subsequent sheet registering action is interrupted.

Figure 8:
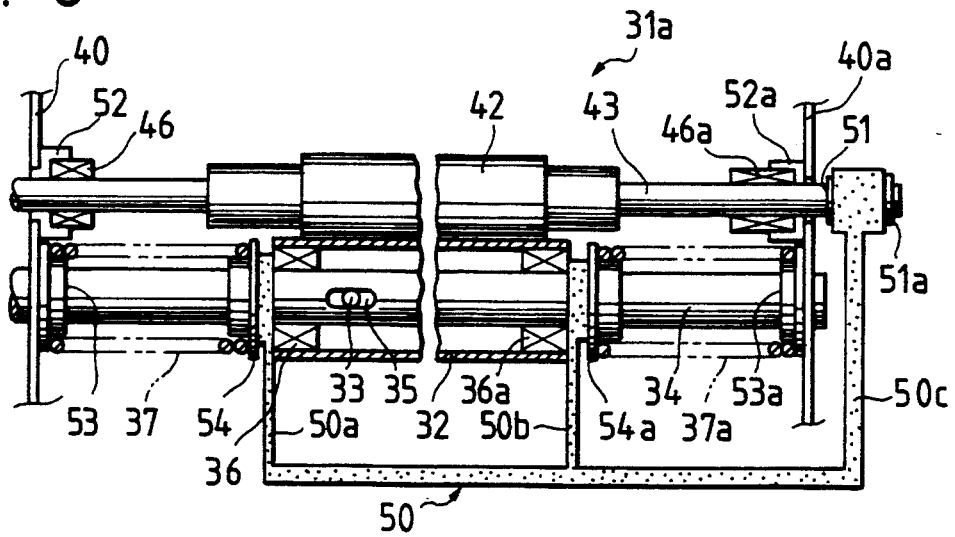
FIG. 8 is a cross sectional view showing an interlocking mechanism of the roller device in the registering unit.

One of the possible ways to solve the problems is to use an interlocking means for interlocking the pinch roller with the drive roller. With provision of the interlocking means, when the drive roller is axially moved, the pinch roller is also moved in the same direction. A registering roller device 31*a* incorporating the interlocking means is shown in FIG. 8. In the instance of the registering roller device shown in FIG. 8, the drive roller 32 is axially slidable with respect to the drive shaft 34. An interlocking member 50 is disposed between the drive roller 32 and the shaft 43 of the pinch roller 42. With provision of the interlocking member 50, both rollers are axially movable together. The roller members in this instance are constructed as in FIGS. 2, 3 and 4. A pin 33 is planted on the shaft. An elongated hole 35 is formed in the roller member. The combination of the pin 33 and the elongated hole 35 is used for transmission of a drive force from the drive roller 32 supported by the drive shaft 34.

In the registering roller device 31*a*, spring receiving members 54 and 54*a* are mounted on the ends of the drive roller 32, respectively. Bearings 53 and 53*a* are mounted on the side walls of the frame, respectively. A spring 37 is disposed between the bearing 53 and the spring receiving member 54, while another spring 37*a*, between the bearing 53*a* and the spring receiving member 54*a*. The spring receiving members 54 and 54*a* support arm members 50*a* and 50*b* of the interlocking member 50, respectively. Another arm member 50*c* of the interlocking member 50 is fastened to the shaft 43 of the pinch roller 42. E rings 51 and 51*a*, which are set on both sides of the portion of the arm member 50*c* where it is fastened to the shaft, prohibits the arm member 50*c* from moving in the axial direction. With this coupling of the arm member, when the drive roller slides along the drive shaft 34, the pinch roller, which is coupled with the drive roller by the interlocking member 50, also slides together with the drive roller. Accordingly, when the sheet is looped in the registering unit and a reaction force of the looped sheet shifts the drive roller in the axial direction, the pinch roller also moves in the axial direction, together with the drive roller. After the sheet passes through the registering unit and the reaction force in the sheet is relieved, the roller members of the registering roller device 31*a* are returned to the neutral positions by the springs, and are ready for the next sheet registering operation.

Figure 9:
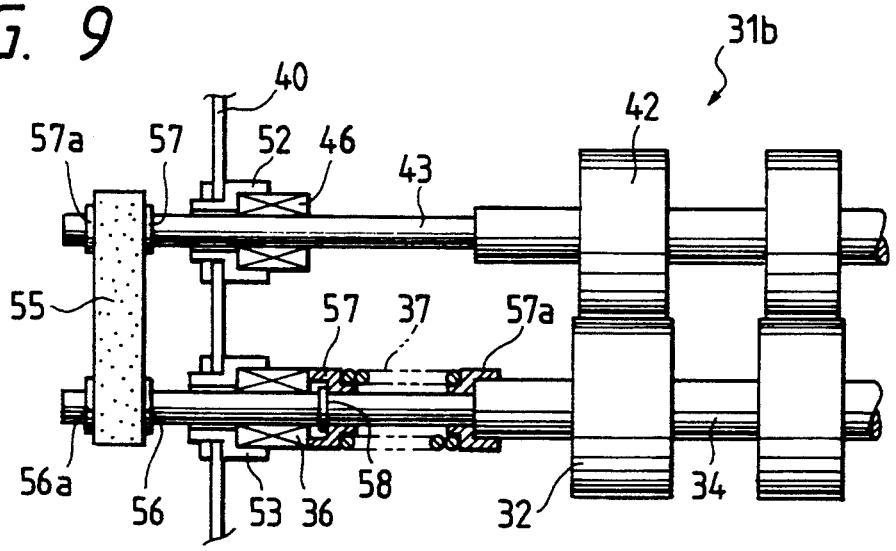
FIG. 9 is a cross sectional view showing another interlocking mechanism of the roller device in the registering unit.

Another registering roller device 31*b* will be described with reference to FIG. 9.

In the registering roller device 31*b*, the drive roller 32 and the pinch roller 42 are fastened to the shafts 34 and 44, respectively. Linear bearings 36 and 46 are respectively installed on the bearings 52 and 53 of the frame. The shafts 34 and 44 are slidable with respect to the linear bearings. A spring 37 is disposed between the drive roller 32 and the linear bearing 36. Brackets 57 and 57*a* sandwich the spring 37. The bracket 57 includes an E ring 58 for positioning purposes. When the reaction force of the looped sheet acts on the drive roller 32 to cause the roller in the axial direction, the drive shaft 34 is moved compressing one of the springs installed on both sides of the drive roller.

In the registering roller device 31*b*, an interlocking member 55 interposes between the two shafts 34 and 43. With use of the interlocking member 55, both the shafts slide in an interlocking manner. One end of the interlocking member 55 is fixed to the drive shaft 34 by means of a couple of E rings, while the other end is fixed to the shaft 43 by E rings 56 and 56*a*. Since the registering roller device 31*b* of FIG. 9 is thus constructed, the drive and pinch rollers can be axially moved by the reaction force of the looped sheet in an interlocking manner. After the sheet passes through the registering unit, the rollers automatically returns to their original or neutral positions.

Figure 10:
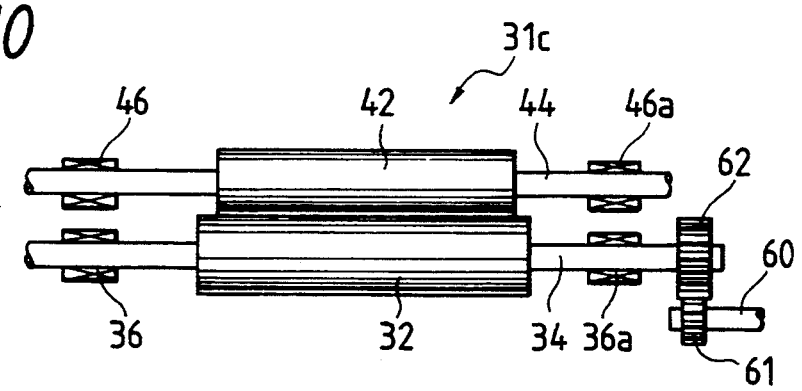
FIG. 10 is a side view showing a drive mechanism for the registering roller device.

In each registering roller device thus constructed, a gear of the drive shaft slides with respect to a gear of the drive mechanism. At this time, a sliding resistance between the gears possibly, if existing, impedes the axial motion of the roller member. The drive force transmission mechanism including those gears will be briefly described with reference to FIG. 10. As shown, a driven gear 62 is mounted around the end part of the drive shaft 34 which supports the drive roller 32. A gear 61 is mounted around the end part of a shaft 60 in the drive mechanism. Those gears 61 and 62 are in mesh with each other for drive force transmission. A sliding resistance existing between those gears will impede the axial motion of the roller member.

Figure 11:
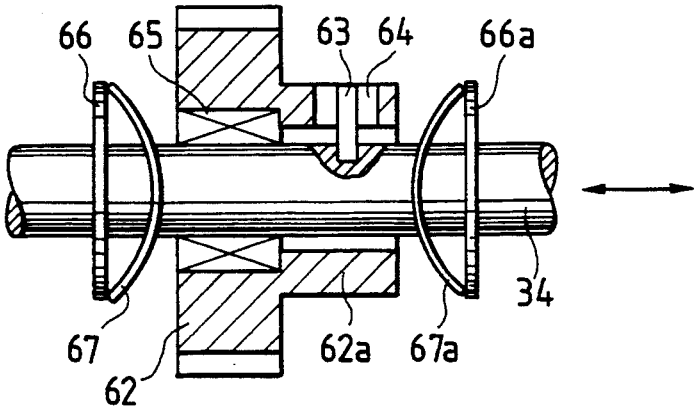
FIG. 11 is a cross sectional view showing a structure in which a driven gear is movable with respect to the drive shaft.

The technical idea of the invention to diminish the sliding resistance may be implemented as shown in FIG. 11. In the figure, a linear bearing 65 is fitted around the drive shaft 34. A driven gear 62 is set around the linear bearing 65. Accordingly, the driven gear 62 is axially slidable with respect to the drive shaft 34. To interlock the driven gear 62 with the drive shaft 34, a pin 63 erected from the shaft 34 is inserted into an elongated hole 64 of a hub 62*a* of the driven gear. Spring washers 67 and 67*a* are disposed on both sides of the driven gear 62. E-rings 66 and 66*a*, fastened to the drive shaft 34, are disposed on the outer sides of the ring washers, respectively. The range within which the driven gear 62 is axially movable is limited between the E-rings 66 and 66*a*.

Figure 12:
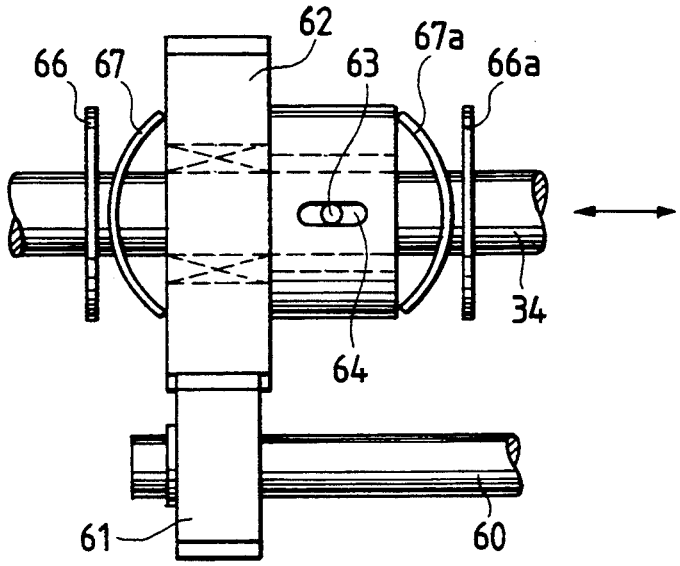
FIG. 12 is a cross sectional view showing another structure in which the driven gear is movable with respect to the drive shaft.

The spring washers 67 and 67*a*, which form the gear motion range defining means, may be disposed as shown in FIG. 12. In the example of FIG. 12, the spring washers are turned over when comparing with those in FIG. 11. Compressed springs or any other types of springs may be used for the same purpose.

Figure 13:
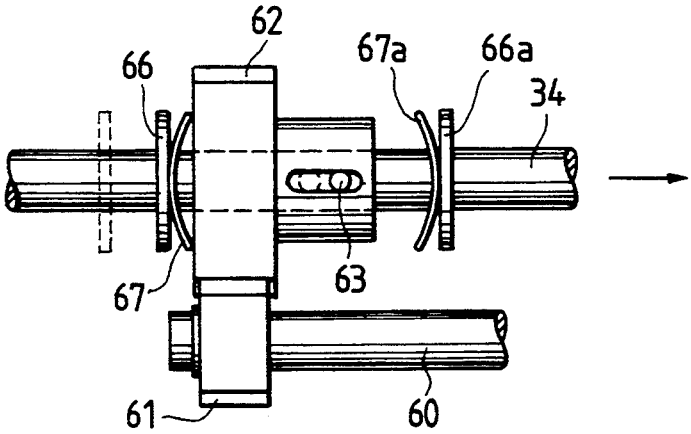
FIG. 13 is a cross sectional view showing a state that the drive shaft is moved to the right.

In the driven gear supporting means shown in FIGS. 11 or 12, the driven gear can be positioned during the course of the axial movement of the drive shaft. When the force by the looped sheet to cause the axial movement is relieved, the driven gear is returned to the neutral position and placed there in a ready-for-next registering operation. As shown in FIG. 13, when the force to move the drive shaft to the right is applied to the shaft, the spring washers move together with the drive shaft 34. The driven gear 62 engaging with the drive gear 61 is not moved in the axial direction, so that it compresses the spring washer 67. When the force to move the drive shaft 34 to the left acts on the shaft, another spring washer 67*a* is compressed (see FIG. 14).

Figure 14:
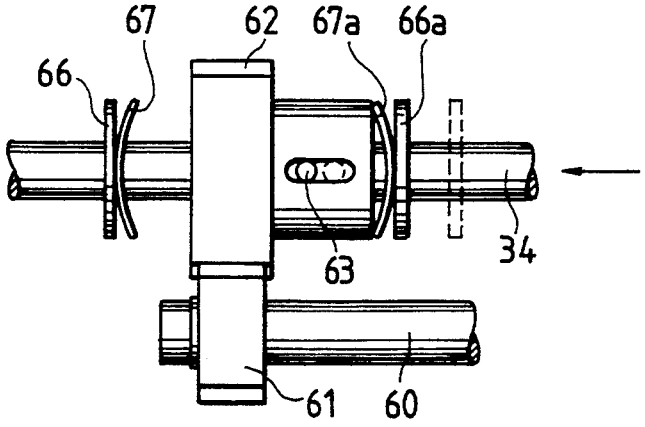
FIG. 14 is a cross sectional view showing a state that the drive shaft is moved to the left.

In a state that the drive shaft is moved to one side as shown in FIGS. 13 or 14, the corresponding spring washer is compressed but the driven gear is not moved in the axial direction. Accordingly, the engagement of the gears is maintained. When the driven gear is axially moved, the drive force transmission from the drive gear to the driven gear is not lost since the pin-elongated hole combination is used. Further, the sliding motion of the drive shaft does not affect any influence on the interlocking mechanism, thereby ensuring a smooth transmission of the drive force. Additionally, the sliding of the roller member is free from the sliding resistance of the gears. Because of this, the sheet registering action based on the reaction force of the looped sheet is not affected by the drive mechanism in any way.

Figure 15:
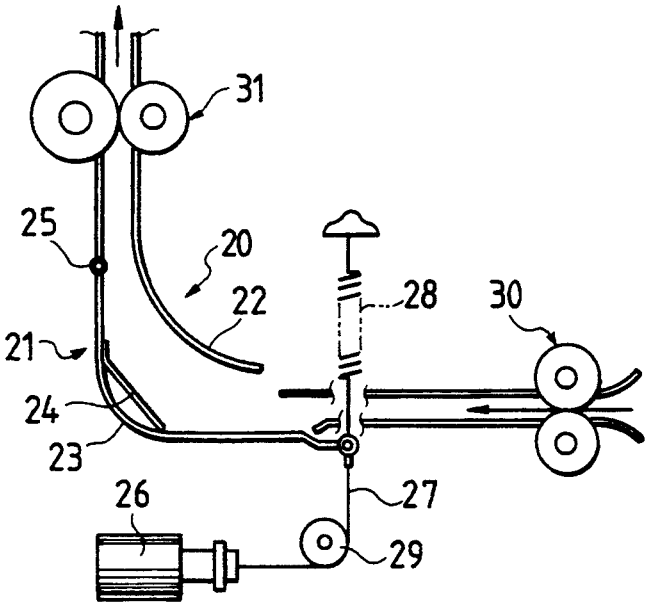
FIG. 15 is a sectional view showing the construction of a sheet registering unit in which the outer guide plate of a sheet transporting path is swingable for open and close.

In the sheet registering unit mentioned above, to register the advancing sheet, the reaction force of the looped sheet in the twisting direction is relieved by moving the rollers of the registering roller device in the sheet width direction. Another inventive mechanism to relieve the reaction force is shown in FIG. 15. In the registering unit 20 shown in FIG. 15, a curved path 21 is defined by an inner guide plate 22 and an outer guide plate 23, both being oppositely disposed. The outer guide plate 23 may be turned for opening and closing on a hinge 25. A spring 28 and a wire 27 are connected to the end of the outer guide plate 23. The wire 27 is coupled with a solenoid 26.

Figure 16:
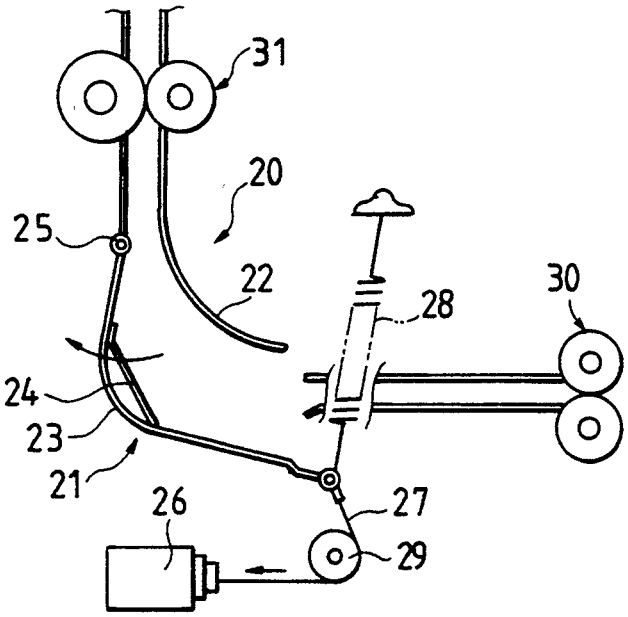
FIG. 16 is a sectional view showing a state of the registering unit of FIG. 15 when the outer guide plate is swung to open.

In the registering unit 20 of FIG. 15, after the sheet is looped and the leading edge of the sheet is aligned with the nip line of the registering roller device by the reaction force of the looped sheet, the registering roller device 31 is driven to feed the sheet to the transfer drum 2. At this time, the solenoid 26 is driven to swing the outer guide plate 23 about the hinge 25 as shown in FIG. 16. As a result, the outer guide plate 23 is opened to relieve the reaction force of the sheet. The sheet having no reaction force of the twisting direction advances to the next stage. After the sheet is fed in a state shown in FIG. 16, if the solenoid 26 is deenergized, the outer guide plate 23 is returned to its original position by the spring 28, and is ready for the next registering operation.

Figure 17:
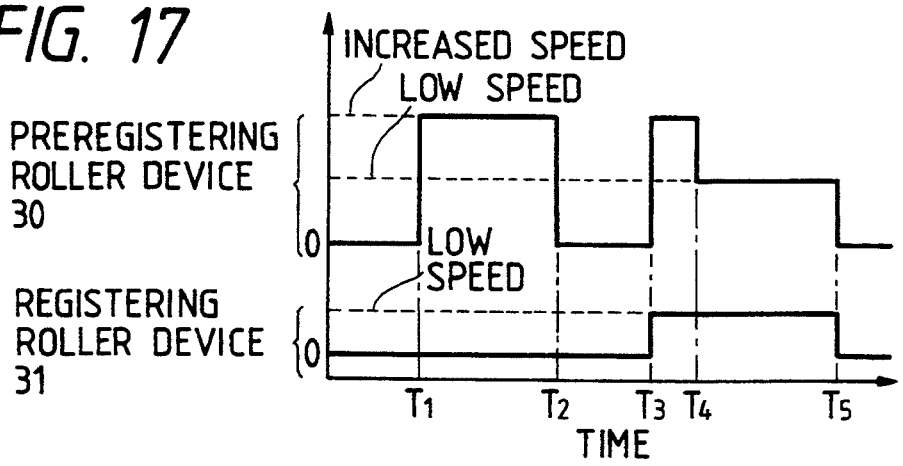
FIG. 17 is a timing chart showing how the registering roller device of FIG. 15 is driven.

In addition to the guide-plate swing mechanism, the registering unit 20 of FIG. 15 further includes means for varying sheet transporting speeds of the paired roller members of the preregistering roller device 30 and the registering roller device 31. The paired roller members are driven at two steps, a low speed (normal transporting speed) and an increased speed (high transporting speed), in accordance with sheet transporting modes (see FIG. 17). In FIG. 17 showing a timing chart, when the leading edge of the sheet enters the sheet registering unit (T1), the preregistering roller device 30 is driven at a high speed. When the leading edge of the sheet thrusts into the nip of the registering roller device (T2), the sheet is looped in the registering unit and temporarily stopped there. With the aid of the loop of the sheet, the leading edge of the sheet is aligned with the nip line of the registering roller device.

When the sheet is fed forward by the registering roller device (T3), the preregistering roller pair as well as the registering roller device is driven at high speed. After some time delay (several msec), the solenoid is triggered by a start signal, which is for starting the registering roller device, thereby to open the outer guide plate. By driving the preregistering roller pair at high speed for a short time (T3 to T4), the sheet is greatly looped in the registering unit. It relieves the reaction force of the twisting direction, which is generated in the sheet when the sheet is looped. After time T4, the two roller devices are driven at low speed, continuously forwarding the sheet. Thereafter, the trailing edge of the sheet is sensed by a sensor disposed near the registering roller device. After a predetermined time elapses since the trailing edge sensing (T5), the two roller pairs are stopped, and the outer guide plate is returned to its original position for the next sheet registering operation.

Figure 18:
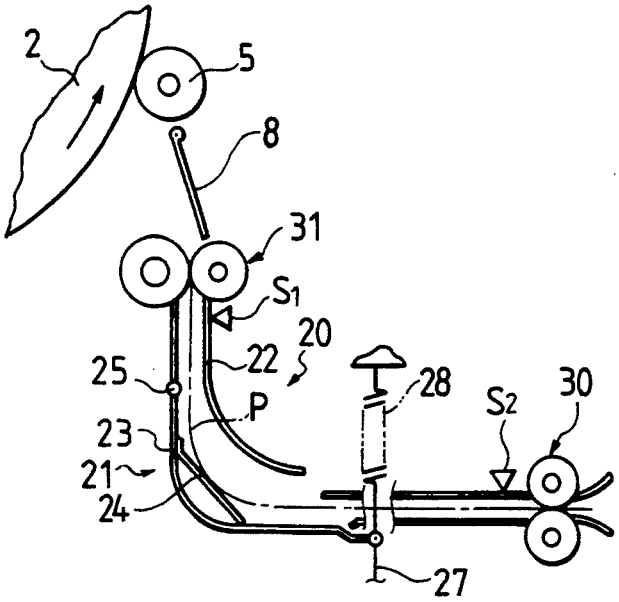
FIG. 18 is a sectional view showing the construction when the mechanism of FIG. 15 is incorporated into the image forming apparatus.

As described above, the cooperation of the curved-path turning mechanism and the roller-speed varying mechanism completely relieves the reaction force in the sheet leaving the registering roller device. Using the registering unit shown in FIG. 15, a mechanism to supply the sheet to the transfer drum 2 may be constructed as shown in FIG. 18. As shown, to set the sheet on the surface of the transfer drum 2, a guide plate 8 and a pressure roller 5 are disposed downstream of the registering unit. The pressure roller 5 is moved toward the transfer drum 2 only when the sheet is set on the surface of the drum. The guide plate 8 may be swung when pressure is applied to the sheet.

Figure 19:
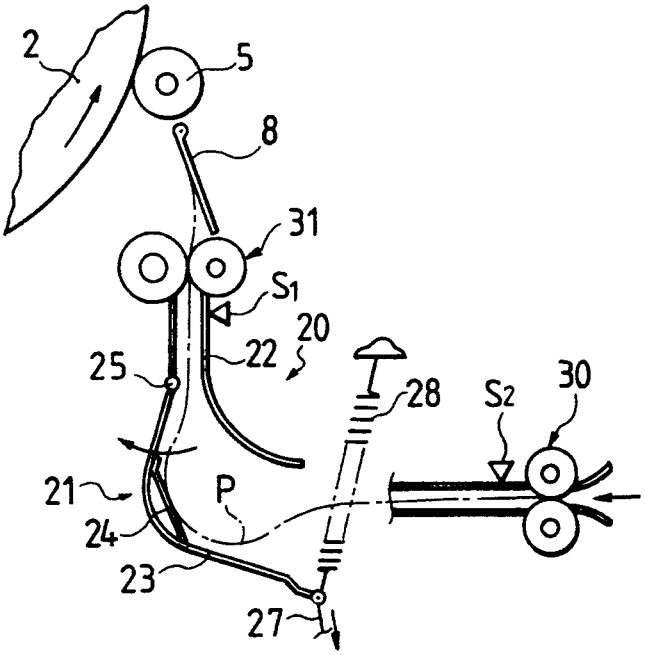
FIG. 19 is a sectional view showing the construction of FIG. 18 when the sheet is released from its looped state.
Figure 20:
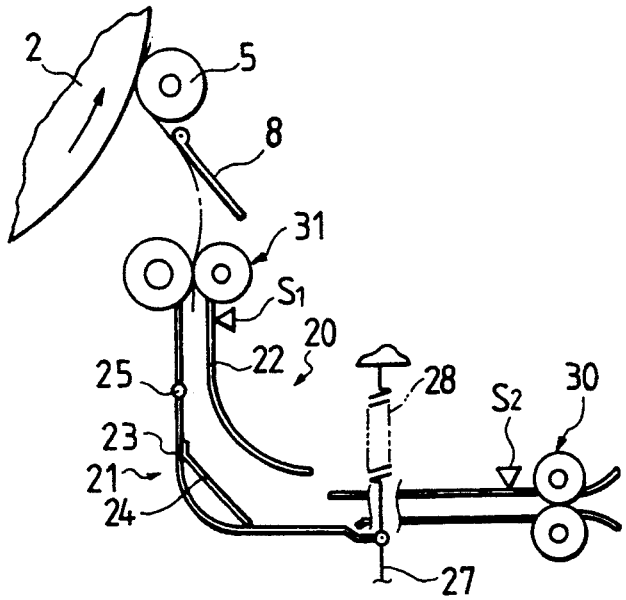
FIG. 20 is a sectional view showing the construction of FIG. 18 when the sheet is supplied to the transfer drum.

In the registering unit shown in FIG. 18, the driving of preregistering roller device 30 continues till the sheet enters the registering unit 20 and the sheet is looped pushing the film 24 disposed at the corner of the curved path 21. After the sheet is satisfactorily looped, viz., after a predetermined time elapses since the sensor S1 senses the leading edge of the sheet, the operation of the preregistering roller device 30 is stopped and waits for a sheet feed signal. Thereafter, as shown in FIG. 19, a signal issued from a control unit of the image forming apparatus drives the registering roller device 31. The operation for feeding the sheet toward the transfer drum starts. In turn, by the drive signal for the registering roller device, the operation to open the outer guide plate 23 starts.

As described above, by opening the outer guide plate, the reaction force in the sheet is relieved. By driving the preregistering roller device 30 at high speed, a large loop is formed in the sheet. After the trailing edge of the sheet is sensed by the sensor S1 and a predetermined time elapses, the sheet is entirely set on the drum surface. The roller device in the registering unit is stopped, and the outer guide plate 23 is returned to its original position for the next sheet registering operation.

The reaction force relieving mechanism is applicable for the registering unit of the type in which the leading edge of the sheet is stopped by the gate member. In this case, one of the two mechanisms mentioned above is used. The sheet is stopped and looped by the gate member, and its leading edge is aligned with the nip line of the registering roller device. At this time, the reaction force of the width direction is generated in the sheet. The reaction force in the sheet is relieved when it leaves the registering roller device. In the subsequent stage, the sheet is exactly positioned, eliminating formation of defective copies. Further, in the registering unit of the invention, the two mechanisms may be combined into a single mechanism. When it is applied for the color copying machine, the sheet is accurately positioned on the transfer drum without any additional pressure applied to the drum.

Another guide plate swing mechanism for relieving the pressure in the looped sheet by swinging the outer guide plate will be described with reference to FIGS. 21 and 22.

Figure 21:
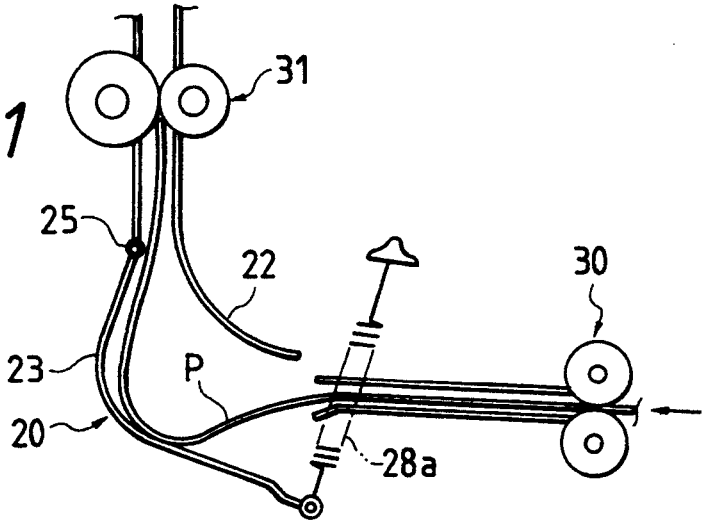
FIG. 21 is a sectional view showing the construction of FIG. 18 when the outer guide plate is opened.
Figure 22:
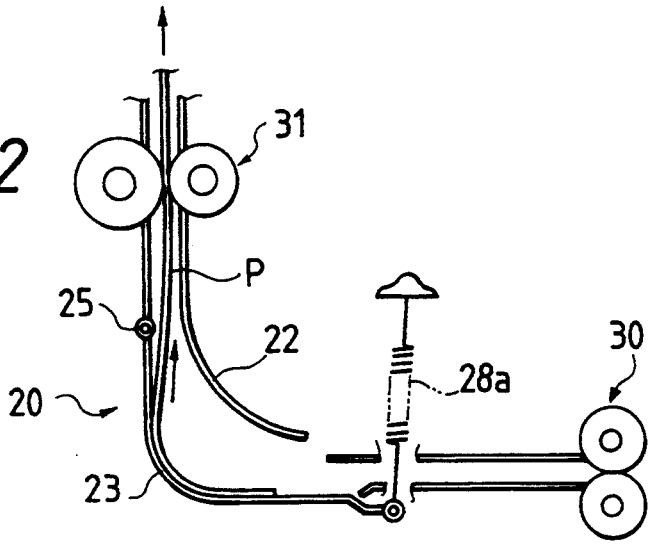
FIG. 22 is a sectional view showing the construction of FIG. 18 when the outer guide plate is closed.

In the guide plate swing mechanism shown in FIG. 21 that is contained in the registering unit, the outer guide plate 23 is swung on a hinge 25. A spring **28*a* functions so as to close the outer guide plate 23. In this instance of the embodiment, the film 24 which pushes the loop of the sheet when it is formed is not used. The solenoid 26** is also not used.

The mechanism shown in FIG. 21 operates in the following way. The leading edge of the sheet P is put to the nip of the registering roller device 31. In this state, the preregistering roller device 30 turns to additionally feed the sheet, to form a loop. Pressure generated in the looped sheet pushes the outer guide plate 23 to open. More exactly, when the pressure of the looped sheet reaches a predetermined value or more, the outer guide plate 23 opens to relieve the pressure in the sheet and hence to prevent the registering rollers from laterally moving. This action ensures good sheet registering operation. As seen from FIG. 21, as the result of relieving the pressure in the sheet, any additional force of the sheet forwarding direction does not exert on the sheet passing through the registering roller device.

Accordingly, during the concurrent operations to set the sheet on the drum surface and to transfer a first image on the sheet, the sheet is not affected by any influence of the sheet forwarding action in the registering unit. Further, since the sheet is forwarded to the transfer drum only by the registering roller device, the sheet that is registered and forwarded to the drum will not be placed to an oblique state by the loop of the sheet. The force of the spring to pull the outer guide plate may be selected to a value in accordance with the type of sheets used. The guide plate swing mechanism of this instance can readily relieve the reaction force in the sheet as the mechanism using the solenoid already described.

In a state shown in FIG. 21, the outer guide plate is swung, the sheet is fed out of the registering unit, and the pressure by the loop is relieved. Then, the outer guide plate 23 is automatically closed by the spring **28*a*, and the state shown in FIG. 22 is set up again. In a case where the sheet is not so hard, the outer guide plate is not opened and guides the sheet while being held by the spring 28*a***.

A further guide plate swing mechanism for relieving the pressure in the sheet will be described with reference to FIGS. 23 and 24.

Figure 23:
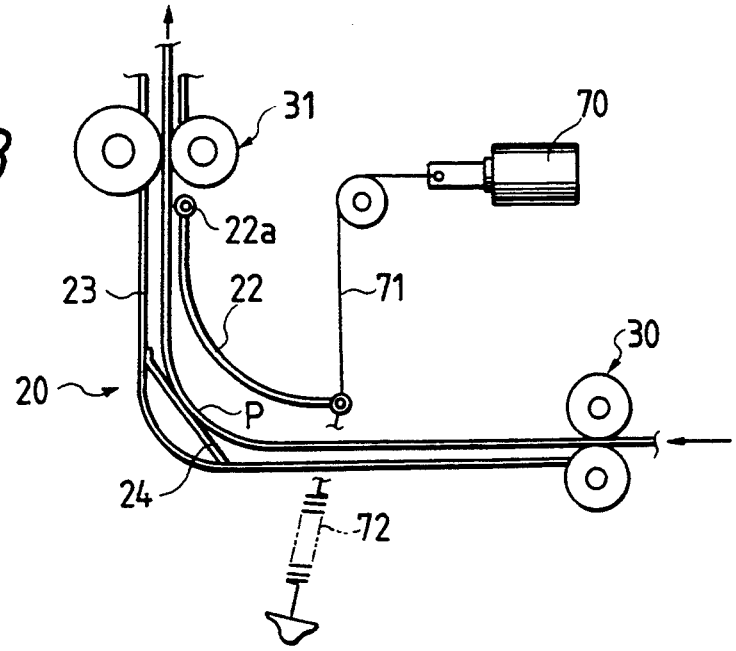
FIG. 23 is a sectional view showing the construction of a sheet registering unit in which the inner guide plate of a sheet transporting path is swung for opening and closing by means of a solenoid.
Figure 24:
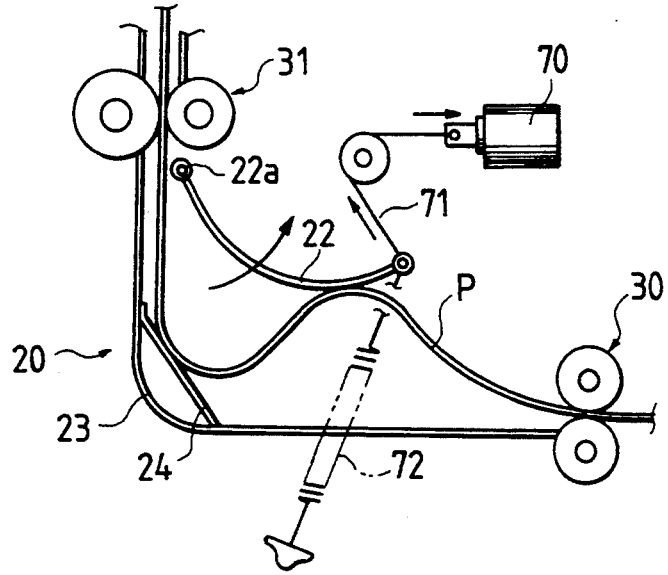
FIG. 24 is a sectional view showing the construction of FIG. 23 when the inner guide plate is opened.

As shown in FIG. 23, the upstream end of the inner guide plate 22 is coupled with a hinge 22*a*, and may be turned on the hinge. The upstream end of the inner guide plate 22 is supported by a solenoid 70 and a spring 72. The spring 72 functions so as to close the inner guide plate 22. The solenoid 70 functions to pull up the inner guide plate 22 by means of a wire 71. In the registering unit 20, the sheet is looped and registered with the aid of the loop. During the registering process, as the loop grows, the upstream part of the sheet is also looped upward as the result of pushing the sheet toward the outer guide plate 23. The pressure in the sheet by the upward loop is relieved by opening the inner guide plate 22, so that any additional pressure does not act on the sheet.

In the registering unit 20 shown in FIG. 23, the sheet is looped, and by the pressure caused by the loop the leading edge of the sheet is aligned with the nip line. Then, the sheet is forwarded toward the transfer drum by the registering roller device 31. At this time, the solenoid 26 is energized to turn the inner guide plate 22 about the hinge 22*a*. As a result, the inner guide plate is open to relieve the stress in the upstream part of the sheet. Accordingly, the sheet having no reaction force in the twisting direction is transported to the next stage. After the sheet is fed out in the state of FIG. 24, the solenoid is deenergized. In turn, the inner guide plate 22 is returned to the original position by the spring 72. The inner guide plate is placed to the state of FIG. 23 and ready for the next sheet registering operation.

Figure 25:
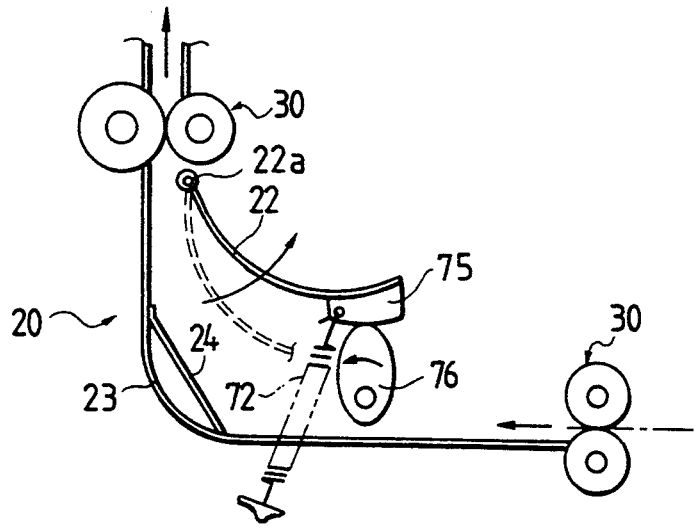
FIG. 25 is a sectional view showing a mechanism for swinging the inner guide plate by cam means.

In the guide plate swing mechanism, the solenoid as a drive means for turning the guide plate may be substituted by any other suitable means. A specific example of the guide plate swing mechanism, which uses cam means in place of the solenoid is shown in FIG. 25. In this example, a cam follower 75 is mounted on the upstream end part of the inner guide plate 22. A cam 76, in contact with the cam follower 75, is mounted on the main body of the apparatus. The cam 76 can be driven by a suitable drive mechanism. Also in this registering unit, after the sheet is looped, control is made so that the pressure by the loop is not to be excessive. Specifically, when the registering roller device is driven to move the sheet toward the transfer drum, the pressure by the loop is relieved by opening the inner guide plate 22 through the operation of the cam means. The sheet can be exactly set on the transfer drum surface, as in the case of FIG. 24.

In the several examples of the pressure relieving mechanisms as described above, the inner or outer guide plate is opened for releasing the looped sheet from the pressure caused by the loop formed when the sheet is fed out of the registering roller device. The same function may be realized by relieving the nip of the preregistering roller pair and/or the registering roller pair. A nip removal mechanism applied for the preregistering roller pair is illustrated in FIG. 26.

Figure 26:
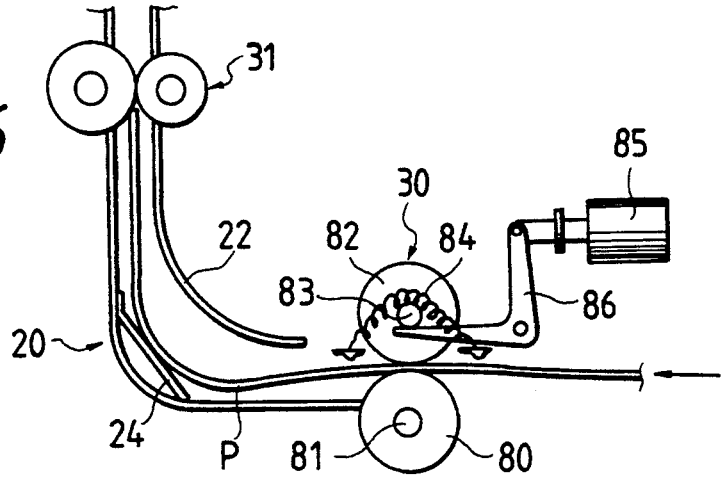
FIG. 26 is a sectional view showing the construction of a sheet registering unit where a nip removal mechanism is installed in the registering roller device.

In the registering unit shown in FIG. 26, when the registered sheet is fed out of the registering unit, the nip removal mechanism included in the preregistering roller device 30 operates to remove the nip of the roller pair for removal of the pressure in the sheet. As shown, in the preregistering roller device 30, a drive roller 80 supported by a drive shaft 81 and a pinch roller 82 supported by a shaft 83 are axially aligned and in contact with each other. To obtain a desired nip pressure, the pinch roller 82 is resiliently held downward by a spring 84. An L-shaped operating arm 86 extended from the solenoid 85 is brought into contact with the lower side of the shaft 83 of the pinch roller 82. To separate the pinch roller 82 from the drive roller 80, the solenoid 85 is driven to lift the shaft 83 by the operating arm 86.

Figure 27:
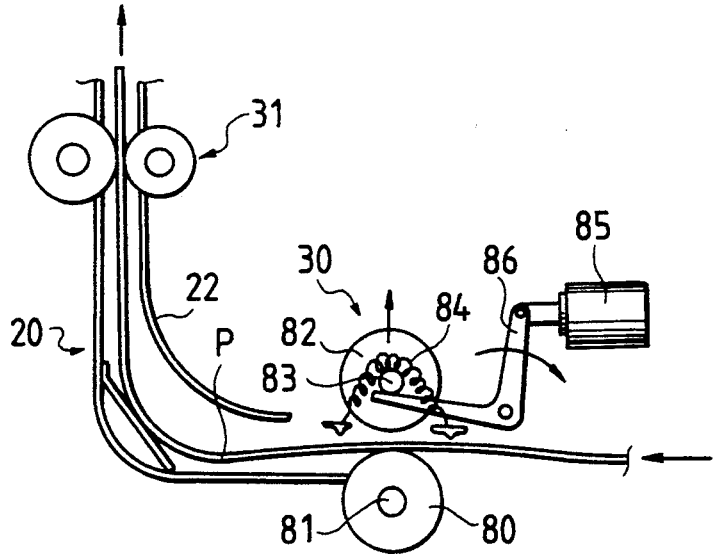
FIG. 27 is a sectional view showing the construction of FIG. 26 where the nip is removed.

In a state that the leading edge of the sheet is temporarily stopped at the nip of the registering roller device 31, the preregistering roller device 30 feeds the sheet to form a loop of the sheet. With the aid of the reaction force generated in the looped sheet, the leading edge of the sheet is aligned with the nip line of the registering roller device. Then, the sheet is fed out of the registering roller device 31. At this time, the solenoid 85 is energized to lift the shaft 83 of the pinch roller 82 through the action of the operating arm 86 (FIG. 27). As a result, the sheet is released from the nipped state, so that the reaction force in the sheet is also removed. The sheet is moved forward by only the forwarding force of the registering roller device 31. Even when the sheet is registered and contains the unwanted stress, the stress is automatically removed through the nip removal action. Accordingly, the sheet emanating from the registering roller device 31 straightly advances.

Figure 28:
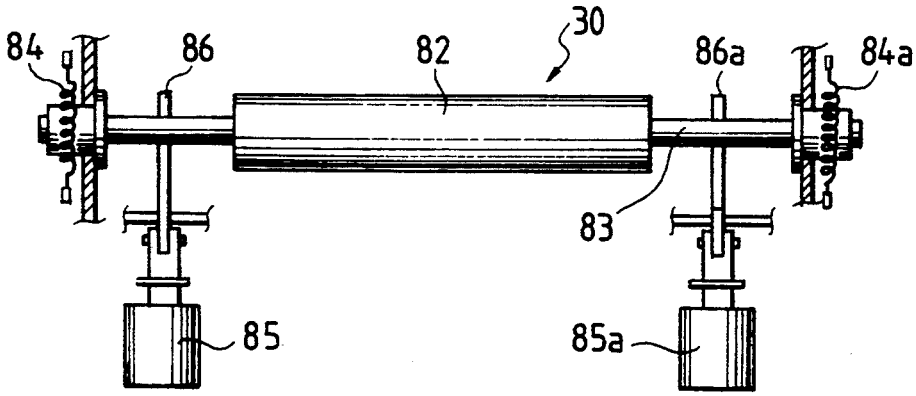
FIG. 28 is a plan view showing the registering roller device shown in FIG. 26.

A specific example of the nip removal mechanism applied for the preregistering roller device 30 may be constructed as shown in FIG. 28.

As shown, solenoids 85 and 85*a* are disposed on both sides of the pinch roller 82 of the preregistering roller device 30. Operating arms 86 and 86*a* extended from the solenoids 85 and 85*a* are brought into contact with the operating points of the shaft 83. The arms 86 and 86*a* of the solenoids 85 and 85*a* are turned so as to separate the pinch roller 82 from the drive roller 80, while resisting the force of the springs 84 and 84*a*, which are for obtaining a desired nip pressure between the paired rollers. If required, a single solenoid, in place of the two solenoids, may be used for driving both the arms. In the registering unit of FIG. 26, the timing of removing the nip can be preset as in the above-mentioned embodiments. Accordingly, the solenoids or solenoid can be driven in synchronism with the sheet leaving the registering unit, more exactly, the roller device 31. Another nip removal means in which a clutch is used and a cam is rotated may be employed.

Another nip removal mechanism will be described with reference to FIGS. 29 through 31. The instant nip removal mechanism is applied for the registering roller device 31 in the registering unit. In the nip removal mechanism operates such that the nip of the registering roller device 31 is removed when the pressure roller 5 presses the sheet against the surface of the transfer drum 2. The nip removal operation starts in response to the motion of a mechanism for swinging the pressure roller 5. The nip removal mechanism in this instance of the embodiment functions to support the centering mechanism of the registering roller device which has a freedom in the thrust direction, and does not function to remove the twist of the sheet caused when the leading edge of the sheet is aligned with the nip line of the registering roller device.

In the registering roller device 31, spring means 115 is applied to the drive roller 32 and the shaft 44 of the pinch roller 42 as shown, thereby gaining a desired nip pressure of the paired rollers. A pressure roller 5 for pressing the sheet against the transfer drum 2 is disposed downstream of the registering roller device 31. The pressure roller 5 is rotatably supported by an arm 6, which is swung about a support shaft 7. A cam follower 8 integral with the arm 6 is in contact with a cam 100, which is fastened to one end of a shaft 101. A disk 105 having protrusions 106 located at predetermined positions, fastened to the other end of the shaft 101, defines the range of rotation of the cam 100. An operating arm 108 of a solenoid 107 is to engage with one of the projections. An eccentric rotation of the cam 100 turns the arm 6 through the cam follower 8, so that the pressure roller 5 mounted on the top of the arm presses the sheet against the drum surface.

Figure 30:
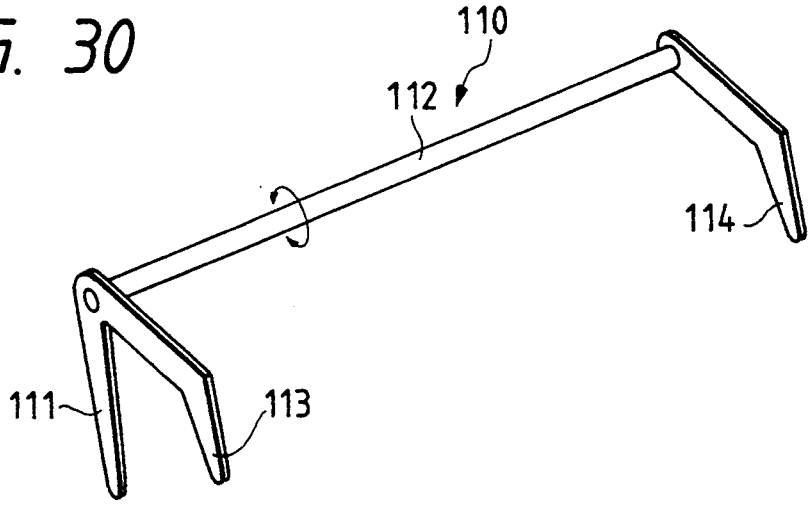
FIG. 30 is a perspective view showing a link means used in connection with the registering roller device shown in FIG. 29.

A link means 110 as shown in FIG. 30 is provided in connection with the cam 100. The link means includes a bar 112, a member having a cam follower 111 and an operating link 113, which is fastened to one end of the bar 112, and an operating link 114 fastened to the other end of the bar. The cam follower 111 comes in contact with the cam 100. Accordingly, when the cam 100 rotates, the link means 110 operates following the cam rotation. With the mechanism thus constructed, when the pressure roller 5 presses the sheet against the drum surface, the pressure by the loop of the sheet is relieved at the registering roller device.

Figure 29:
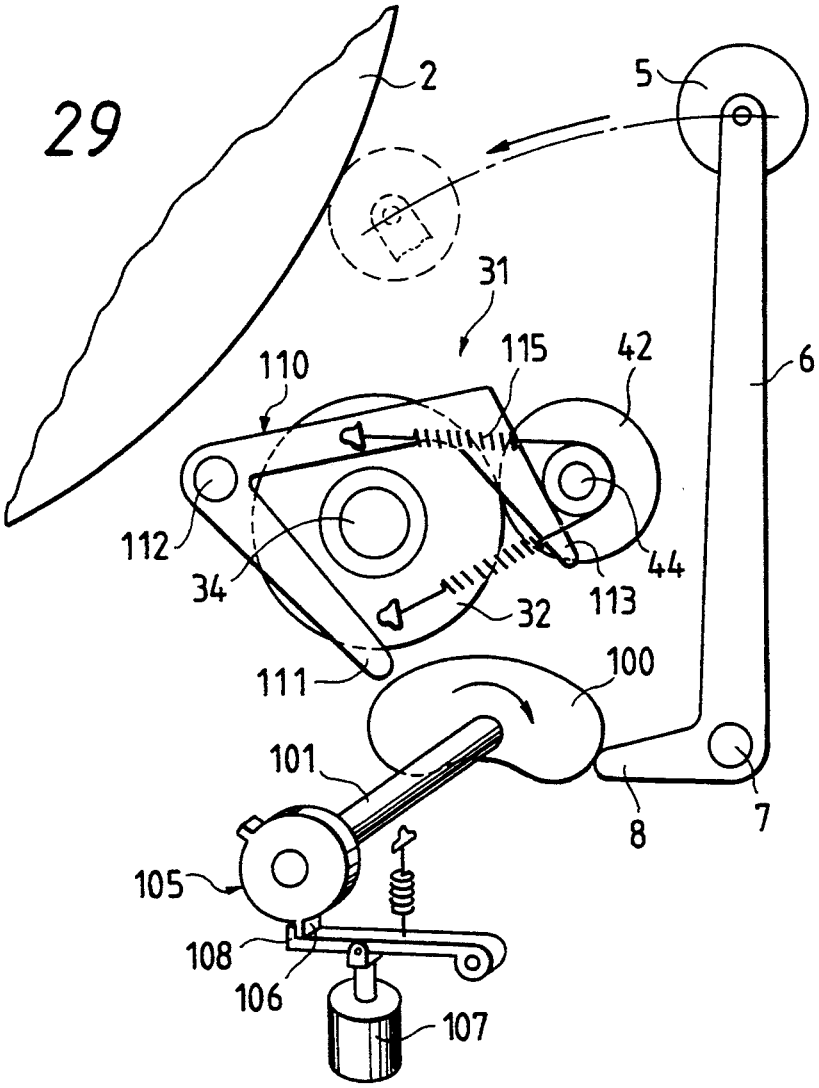
FIG. 29 is a side view showing an interlocking mechanism for the pressure roller and the registering roller device.
Figure 31:
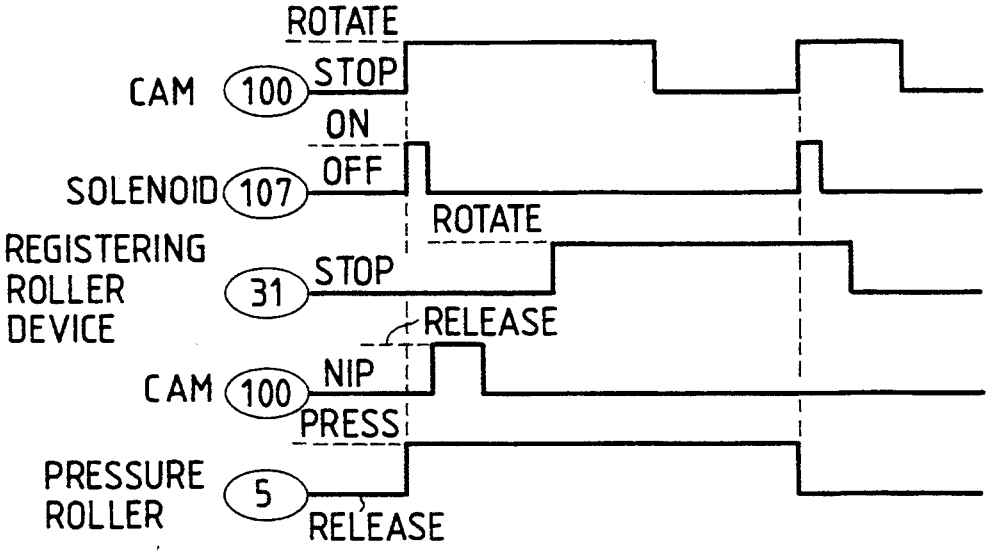
FIG. 31 is a timing chart showing the operation of the mechanism of FIG. 29.

The nip removal mechanism shown in FIG. 29 operates according to a timing chart of FIG. 31. In operation, when the sheet is fed out of the registering unit, the cam 100 starts to rotate, so that the pressure roller 5 is moved toward the transfer drum 2. At the same time, the link means 110 is turned to remove the nip between the paired rollers of the registering roller device 31. The operation of the cam 100 and the operation of feeding the sheet from the registering roller device 31 are timed as shown in FIG. 31.

To drive the cam 100, the arm 108 of the solenoid 107, of which the distal end has engaged with the projection on the outer peripheral side of the disk, disengages from the projection, thereby allowing the cam 100 to rotate. On the other hand, the registering roller device 31 is driven to feed the sheet toward the transfer drum 2. In this case, the nip of the paired rollers of the registering roller device 31 is removed before a toner image is transferred onto the sheet which has forcibly set at the leading edge on and electrostatically attracted to the drum surface. In other words, the reaction force in the looped sheet is relieved or removed, so that the sheet is normally set on the drum surface.

The nip removal operation and the operation of pressing the sheet against the drum surface are timed as illustrated in the timing charge of FIG. 31. As seen, after a predetermined time elapses since the pressure roller starts to press the sheet against the drum surface, the nip of the paired rollers is temporarily removed or released. As described above, the cam 100 can be properly shaped to effect the swing of the pressure roller 5 and the removal of the nip of the paired rollers. The disk 105, coupled with the cam 100 by the shaft 101 and rotates together with the cam, is controlled in rotation by the solenoid 107 so that after one turn of the cam, the cam stops at a predetermined position.

During the course of one turn, the cam is temporarily stopped. For example, when the cam is turned by 240°, the cam is temporally stopped, and then the pressing operation by the pressure roller is stopped before the subsequent 120° turn ends. Specifically, engagement of the arm 108 of the solenoid 107 with the two protruded pieces 106 protruded from the outer peripheral side of the disk 105 is so controlled as to effect the above sequence of operation. The nip of the rollers is removed before the image is formed on the sheet already set on the drum surface. Accordingly, the reaction force in the sheet is removed immediately after the leading edge of the sheet is thrust against the drum surface. Thereafter, the nip of the paired rollers is set up again, ensuring a normal feeding of the sheet.

Immediately after the roller separation by the link means 110 is removed, the paired rollers are brought into contact with each other by the spring 115, thereby to nip the sheet again, and ready for the subsequent sheet registering operation. In other words, it can reliably nip the leading edge of the sheet when the next sheet reaches the registering unit and is looped for registering operation. It is evident that the registering roller device 31 of this instance may be arranged as to allow the sheet to move in its width direction, as in the FIG. 2 case.

Each registering unit thus far described, when it is applied for a color copying machine, does not require any complicated construction. In the registering unit, the mechanism to move the sheet in its width direction by utilizing the pressure in the looped sheet and/or the mechanism to remove the reaction force in the looped sheet are additionally used. Accordingly, the registering unit can be realized with a relatively simple construction. The registering unit removes the reaction force in the looped sheet before it is fed toward the transfer drum 2. Accordingly, the sheet will not deform the film member on the transfer drum 2. Further, when color toner images are superposedly transferred, a discrepancy in color will not be caused. The resultant color image has a good image quality.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. In a sheet registering unit for an image forming apparatus in which in a location upstream of a transfer stage, a preregistering roller device and a registering roller device are disposed while being separated with a predetermined distance from each other, and a leading edge of a sheet of paper is positioned with the aid of a loop of the sheet formed in a manner that the leading edge is thrust against a nip of paired roller members of the registering roller device, and that the sheet is additionally pushed by the preregistering roller pair, the improvement comprising:

a pair of shafts, one of the pair supporting each of said paired roller members of said registering roller device;

linear bearing members interposed between at least one of said pair of shafts and a corresponding roller member; and springs proximate the ends of at least one of said paired roller members, said springs and bearing members allowing at least one of said paired roller members to shift axially when a pressure is applied in an oblique direction to said paired roller members by said sheet of paper.

2. The sheet registering unit according to claim 1, wherein said roller members are slidably mounted around a drive shaft fastened to a frame, a shaft for a pinch roller is slidably mounted in the axial direction by means of bearing means of the frame, an interlocking member, coupled with the roller member supported by said drive shaft, causes the shaft for the pinch roller to slide through the bearing means in an interlocking manner, and when the sheet is looped through the cooperation of said roller devices, a reaction force generated in the looped sheet causes the drive roller member to move in the axial direction, and the pinch roller is concurrently moved in the same direction.

3. The sheet registering unit according to claim 1, wherein the roller member is supported by a drive shaft slidably coupled with bearing means fastened to a frame, a shaft for a pinch roller is slidably mounted in the axial direction by means of bearing means of the frame, an interlocking member, coupled with the roller member supported by said drive shaft, causes the shaft for the pinch roller to slide through the bearing means in an interlocking manner, and when the sheet is looped through the cooperation of said roller devices, a reaction force generated in the looped sheet causes the drive roller member to move in the axial direction, and the pinch roller is concurrently moved in the same direction.

4. The sheet registering unit according to claim 1, further comprising:

a drive roller and a pinch roller of said registering roller device provided slidably in the axial direction by bearing means mounted on a frame, a gear mounted on a drive shaft for the drive roller in a manner that said gear is movable in the axial direction, and means for limiting the range of axial movement of said gear and means for transmitting a drive force between said gear and said drive shaft.

5. The sheet registering unit according to claim 1, wherein the roller members of the registering roller device are movable in the axial direction and further comprising:

a transfer drum supporting the sheet in the transfer stage and including a plastic film, a sheet registering stage is disposed upstream of the transfer drum as viewed in a sheet transporting direction, when the sheet is set on the transfer drum, the pressure of the sheet in the oblique direction causes the roller members of said registering roller device to move and hence to remove the pressure from the sheet.

6. The sheet registering unit according to claim 5, further comprising:

a curved sheet transporting path, the preregistering roller device disposed upstream of the curved path and the registering roller device disposed downstream thereof, an outer guide plate partly defining the curved path swingable for opening and closing, when the sheet is fed forward by said registering roller device, the outer guide plate opens to remove the pressure of the looped sheet.

7. The sheet registering unit according to claim 5, further comprising:

a curved sheet transporting path, the preregistering roller device disposed upstream of the curved path and the registering roller device disposed downstream thereof, an inner guide plate partly defining the curved path swingable for opening and closing, when the sheet is fed forward by said registering roller device, the inner guide plate opens to remove the pressure of the looped sheet.

8. The sheet registering unit according to claim 5, wherein one of the roller devices disposed upstream and downstream of the registering stage is provided with nip removal means, and further comprising:

control means for operating said nip removal means when the registered sheet is fed forward, whereby removing a stress in the twisting direction in the sheet to be fed forward.

9. A sheet transporting device for correcting a sheet transporting position, comprising first and second roller pairs including rotating shafts, said first roller pair being movable along the rotating shafts by a deflection force in an oblique direction that is generated in a sheet of paper in a state that the sheet is nipped by said first roller pair and in contact with said second roller pair.

10. The sheet transporting device according to claim 9, wherein said first roller pair includes a drive roller and a pinch roller, said drive roller having a drive force transferring mechanism in which a pin disposed on the rotating shaft engages with an elongated hole formed on a roller member.

11. The sheet transporting device according to claim 10, wherein an edge portion of the rotating shaft of said drive roller is provided with a driven gear which is engaged with a gear of drive means, a movable range of said driven gear being limited by a limitation mechanism.

12. The sheet transporting device according to claim 11, wherein said limitation mechanism includes two spring washers positioned on both sides of said driven gear, and two E-rings fixed to the rotating shaft of said drive roller on outer sides of said spring washers.

13. The sheet transporting device according to claim 10, wherein said drive roller and said pinch roller are connected through a connecting member.

14. An image forming apparatus comprising a transfer drum having a flexible sheet holder member for electrostatically holding a sheet of paper on a surface of the transfer drum, and a sheet positioning device for supplying the sheet to the transfer drum, wherein said sheet positioning device comprises first and second roller pairs including rotating shafts, said first roller pair being movable along the rotating shafts by a deflection force in an oblique direction that is generated in the sheet in a state that the sheet is nipped by said first roller pair and in contact with said second roller pair.

15. The image forming apparatus according to claim 14, further comprising a photoreceptor member having a toner image thereon and disposed close to said transfer drum, and transferring means for transferring the toner image onto the sheet, wherein during the operation of transporting the sheet to said transfer drum, said transfer means is operated.

16. The image forming apparatus according to claim 15, wherein toner images of different colors are transferred onto the sheet by rotating said transfer drum.

17. The image forming apparatus according to claim 14, wherein said first roller pair includes a drive roller and a pinch roller, said drive roller having a drive force transferring mechanism in which a pin disposed on the rotating shaft engages with an elongated hole formed on a roller member.

18. The image forming apparatus according to claim 17, wherein an edge portion of the rotating shaft of said drive roller is provided with a driven gear which is engaged with a gear of drive means, a movable range of said driven gear being limited by a limitation mechanism.

19. The image forming apparatus according to claim 18, wherein said limitation mechanism includes two spring washers positioned on both sides of said driven gear, and two E-rings fixed to the rotating shaft of said drive roller on outer sides of said spring washers.

20. The image forming apparatus according to claim 17, wherein said drive roller and said pinch roller are connected through a connecting member.

* * * * *